US005415239A

United States Patent [19]

Kötter et al.

[11] Patent Number: 5,415,239

[45] Date of Patent: May 16, 1995

[54] SPRINKLER FOR AUTOMATIC FIRE EXTINGUISHING PLANT

[75] Inventors: Karl Kötter, Rösrath; Herbert Schaefers, Overath, both of Germany

[73] Assignee: Total Walther Feuerschutz GmbH, Köln, Germany

[21] Appl. No.: 911,202

[22] Filed: Jul. 9, 1992

[30] Foreign Application Priority Data

Jul. 9, 1991 [DE] Germany ..... 41 22 665.8

[51] Int. Cl.[6] ..... A62C 37/09

[52] U.S. Cl. ..... 169/41; 169/37

[58] Field of Search ..... 169/16, 17, 19, 37–41, 169/90; 285/39, 357; 239/209

[56] References Cited

U.S. PATENT DOCUMENTS

| | | | |
|---|---|---|---|
| 1,780,402 | 11/1930 | Recko | 285/39 |
| 2,117,357 | 5/1938 | Peterson | 285/39 |
| 2,155,990 | 4/1939 | Hodgman, Jr. | 169/39 |
| 2,180,258 | 11/1939 | Rowley | 169/41 |
| 2,871,953 | 2/1959 | Bray | 169/37 |
| 3,191,316 | 7/1965 | Faulkner et al. | 169/37 |
| 3,529,671 | 9/1970 | Adams, Jr. | 169/41 |
| 3,675,952 | 11/1972 | Mears | 169/41 X |
| 3,807,503 | 4/1974 | Iasillo, Sr. | 169/37 |
| 3,992,043 | 11/1976 | Whitley | 285/39 |
| 4,007,877 | 2/1977 | Jackson et al. | 169/37 X |
| 4,007,878 | 2/1977 | Anderson | 169/37 X |
| 4,083,410 | 4/1978 | Anderson | 169/37 |
| 4,091,872 | 5/1978 | Mountford | 169/37 |
| 4,177,862 | 12/1979 | Bray | 169/17 |
| 4,220,208 | 9/1980 | Jackson et al. | 169/17 |
| 4,237,982 | 12/1980 | Sclafani | 169/37 |
| 4,258,795 | 3/1981 | Hansen | 169/19 |
| 4,417,626 | 11/1983 | Hansen | 169/37 |
| 5,002,318 | 3/1991 | Witter | 169/37 X |
| 5,028,078 | 7/1991 | Schwarz et al. | 285/39 X |
| 5,149,144 | 9/1992 | Blakeley | 285/39 X |

FOREIGN PATENT DOCUMENTS

| | | | |
|---|---|---|---|
| 2816369 | 10/1978 | Germany | 169/17 |
| 726236 | 3/1955 | United Kingdom | 169/41 |
| 1221706 | 2/1971 | United Kingdom | 169/37 |
| 2123689 | 2/1984 | United Kingdom | 169/58 |

*Primary Examiner*—David M. Mitchell
*Assistant Examiner*—Gary C. Hoge
*Attorney, Agent, or Firm*—Horst M. Kasper

[57] ABSTRACT

A sprinkler for automatic fire extinguishing plants according to the dry system is furnished for rooms subjected to and endangered by freezing and frost. Such plants are furnished in particular in case of the presence of a suspended ceiling with downwardly branching pipe pieces. In order to adapt the downwardly branching pipe pieces to the prevailing construction conditions, the branching pipe pieces are furnished by two pipe pieces screwed to each other. The two pipe pieces exhibit a support body at the upper end and a sprinkler at the lower end. The two parts are connected via two rods or pipes, screwed to each other, to form the special sprinkler.

18 Claims, 1 Drawing Sheet

SPRINKLER FOR AUTOMATIC FIRE EXTINGUISHING PLANT

BACKGROUND OF THE INVENTION

1. Field of the Invention

The invention relates to a sprinkler for an automatic fire extinguishing plant based on the dry system for rooms or the like, endangered by freezing and frost, where there are provided downwardly branching pipe pieces, starting at threaded surfaces of connection pipes, screw necks or adapter connections of the fire extinguishing agent line of the plant, wherein the branching pipe pieces are furnished at their upper end with a seal, and the branching pipe pieces are furnished with a sprinkler at their lower end, and wherein a suspended ceiling is disposed in the region of the lower end of the pipe pieces supporting the sprinkler, which ceiling only makes visible the fire extinguishing sprinkler roses.

2. Brief Description of the Background of the Invention Including Prior Art

Such sprinklers are employed substantially only in rooms endangered by freezing and frost (German Printed Patent Document DE-OS 17 08 090). Such sprinklers are also employed with suspended ceilings in sales rooms and halls of department stores or the like, compare German Petit Patent DE-GM 89 09 716, if the hall space located above the suspended ceiling are endangered by freezing and frost. In this case, there is furnished an upper end closure of the pipe pieces. According to sprinkler plants according to the German Printed Patent Document DE-OS 17 08 090, the upper end is formed as a membrane, where the durability of the membrane is only very limited.

The upper termination or end closure is required so that no residual water remains in the pipe piece after the emptying of the plant.

According to the subject matter of the German Petit Patent DE-GM 89 09 716, the sprinklers are connected via a flexible hose piece to the fire extinguishing agent line. A separate suspension and support device is on the one hand connected lengthwise adjustable to the hall ceiling and, on the other hand, to the sprinkler. The hose pieces have to be firm and reliable against pressure and have to be pressure sealed up to 10 bars according to regulations. These pressure stable tubes and pressure-resistant hoses are in fact bendable, pliable, and flexible, however, they cannot accept pressure forces or, respectively, tensile forces. This means that the length of the hose has to be adapted to the distance in case of changing distances between the suspended ceiling and the ceiling of the hall structure. This results in substantial difficulties during assembly on the construction site.

The suspended ceilings are applied to the ceiling of the room of the building based on prevailing construction conditions with tolerances of from about 2 to 5 centimeters (cm). Furthermore, the network of pipes is installed with an incline or a descending slope for the extinguishing agent lines, in order to allow the grid or network of pipes to be emptied of water, if desired.

As a consequence of the two latter recited provisions, the pipe pieces supporting the sprinkler have to be incorporated and built in at the construction sites with different longitudinal lengths. This means, that the downwardly leading pipe pieces of different length have to be produced at the construction site in order to be adapted to the prevailing construction conditions. Alternatively, the pipe pieces have to be produced in the workshop of the manufacturer according to the detailed instructions of the person assembling the sprinkler plant.

Both the adaptation of the pipe pieces at the construction site as well as adaptation in the shop are very time-consuming and result in high costs.

SUMMARY OF THE INVENTION

Purposes of the Invention

It is an object of the invention to provide a sprinkler system, where the sprinklers are suspended from pipe pieces in case of suspended ceilings in rooms which are endangered by freezing and frost, wherein the sprinkler balances and compensates for the tolerances furnished by the prevailing construction conditions, and wherein the differences furnished based on the inclination or descending slope of the fire extinguishing agent line relative to the suspended ceiling are compensated without adaptation at the construction site or in the workshop, and wherein a storage production of such sprinklers with pipe pieces is made possible.

It is another object of the present invention to provide a sprinkler system which is suitable for rooms subjected to freezing and which allows assembly without additional machining steps.

It is yet another purpose of the present invention to provide a system for a sprinkler plant, which can be easily installed in connection with suspended ceilings, even in cases where the distance between the suspended ceiling and the ceiling of the room varies.

These and other objects and advantages of the present invention will become evident from the description which follows.

Brief Description of the Invention

According to the present invention, there is provided for a sprinkler branch for automatic fire extinguishing plants. An upper pipe has a first threaded surface on an upper end for fitting the upper pipe onto a downward threaded arm of a tee fitting in a line for carrying a fire extinguishing agent. The upper pipe has a second threaded surface on the upper end and having a third threaded surface on a lower end. A lower pipe has a first threaded surface on an upper end and a second threaded surface on a lower end. The upper pipe with the third threaded surface and the lower pipe with the first threaded surface are screwed together. A sleeve seat is connected to the upper pipe. A support body is disposed in the sleeve seat. The support body can be pressed against a threaded sleeve seat. An upper rod has an upper end and a lower end. The upper rod has at its lower end a first rod thread. The upper rod is attached at the upper end of the upper road to the support body. A lower rod has an upper end and a lower end. The lower rod has at its upper end a second rod thread. The first rod thread matches the second rod thread. The upper end of the lower rod is screwed to the lower end of the upper rod. A sprinkler body is attached to the lower end of the lower pipe. A sprinkler support piece is connected to the lower end of the lower rod. The sprinkler body and the sprinkler support piece form a sprinkler device such that the sprinkler branch is operable according to the dry system and for rooms endangered by freezing and frost or the like. A suspended ceiling is disposable in a region defined by the lower pipe and the sprinkler device.

An upper guide element can be furnished between the upper rod and the upper pipe for preventing mutual rotation of the upper rod relative to the upper pipe. A lower guide element can be furnished between the lower rod and the lower pipe for preventing mutual rotation of the lower rod relative to the lower pipe.

A sealing ring can be inserted between the threaded sleeve seat and the support body.

The support body can include an annular groove. The sealing ring can be inserted into the annular groove of the support body.

The threaded sleeve seat can exhibit a bore. The bore of the threaded sleeve seat can exhibit a conically expanding surface in a direction toward the sprinkler device. The threaded sleeve seat can form a valve seat. The support body with its outer face can rest against the bore.

A first hexagonal jam nut or wrenching collar can be attached at an outer face of the upper pipe. A second hexagonal jam nut or wrenching collar can be attached at an outer face of the lower pipe. The outer periphery of the second hexagonal jam nut, attached to the outer face of the lower pipe, can be smaller as compared to the outer periphery of the first hexagonal jam nut.

The third threaded surface of the upper pipe, the first threaded surface of the lower pipe, the first rod thread of the upper rod, and the second rod thread of the lower rod can be disposed at substantially the same height level.

The first rod thread, the second rod thread, the third threaded surface of the upper pipe, and the first threaded surface of the lower pipe can have the same pitches.

The upper pipe can be formed as a coupling, and the lower pipe can be formed as a coupling.

The sprinkler body can be furnished with an upper step. Said step can define a minimum and a maximum for an inner circle of a ring washer. The outer diameter of the washer can be provided sufficient for resting at an edge of a hole in a ceiling panel.

The sprinkler body can be furnished with a threaded surface on an upper end for attachment to the second threaded surface of the lower pipe.

A release member can have a first end and a second end. The sprinkler support piece can arrest a first end of the release member. A counter support can support the second end of the release member and can simultaneously provide a sprinkler rose for imparting a horizontal speed component to a fluid arriving through the lower pipe. Sprinkler arms can attach the sprinkler rose to the sprinkler body. The threaded surface of the sprinkler body can be an outer thread. The second threaded surface of the lower pipe can be an inner thread.

A dry system in connection with an automatic fire extinguishing plant can provide that any pipes or fire extinguishing agent lines disposed in a room, subjected to and endangered by freezing and frost, are only filled with extinguishing agents at points in time when such agents are needed for extinction of a fire or the like. Fire extinguishing or suppressing agents can include water, liquid nitrogen, carbon dioxide, and other fire fighting fluids.

According to the present invention the pipe pieces are comprised of a two-part, lower and upper pipe, where the upper and lower pipes are screwed together with threads. The sprinkler with the sprinkler body is screwed into the lower end of the lower pipe. The release member, which is arresting the sprinkler support piece sprinkler, is connected to a pipe or a rod. The pipe or the rod is screwed together with a further pipe or rod. The further pipe or rod is furnished at its upper end with a support body. The support body can be pressed against a threaded sleeve seat, where the threaded sleeve seat forms a valve seat and is connected to the pipe. The threads connecting the two pipes and the two rods are furnished with the same size of thread slopes and/or pitches.

The construction tolerances and the height level differences can be balanced without difficulty during mounting and assembly based on this step. A particular advantage of this construction includes that the sprinkler, produced in a workshop, can be placed with the subdivided pipe pieces into the threaded arm of a tee fitting of the extinguishing agent line, and then, based on the same thread slopes and/or pitches in the two subdivided pipe pieces, can be uniformly adjusted to such a point until the desired height level is reached. For this purpose, the outer pipes and the inner rods have to be connected fixed against rotation in each case. A sealing ring is furnished between the upper threaded insert connection, forming the valve seat, and the support body for sealing the fire extinguishing agent line relative to the branching pipe piece.

A stud, a threaded pipe, or an adapter connection can provide the threaded arm of the tee fitting.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown a possible embodiment of the present invention.

DESCRIPTION OF INVENTION AND PREFERRED EMBODIMENT

Figure 1:
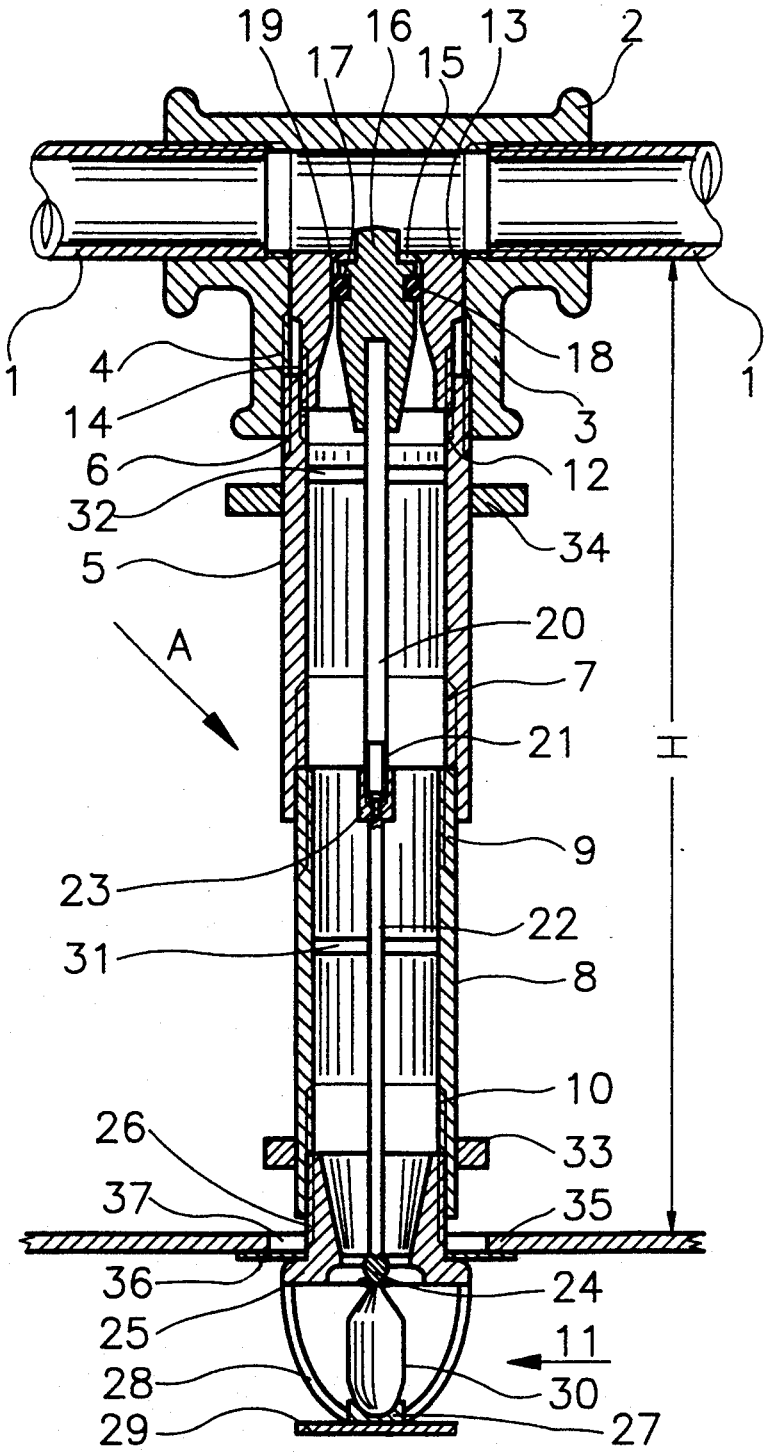
FIG. 1 is a schematic sectional view of a sprinkler furnished for a suspended ceiling.

According to the present invention, there is provided for a sprinkler for automatic fire extinguishing plants according to the dry system, for rooms endangered by freezing and frost or the like. Pipe pieces branch downwardly from threaded arm of a tee fitting of the fire extinguishing agent line of the plant. The branching pipe pieces carry at their lower end the sprinkler. A suspended ceiling is disposed in the region of the lower branching pipe pieces. The two part pipe A is formed by an upper pipe 5 and lower pipe 8. The upper pipe 5 and the lower pipe 8 are screwed together with threads 9, 7. The sprinkler 11 with the sprinkler body 25 is screwed into a lower end of the lower pipe 8. A sprinkler support piece 24, arresting the release member 30, is connected with a lower rod 22. The lower rod 22 is screwed to an upper rod 20. The upper rod 20 is furnished at its upper end with a support body 16. The support body 16 can be pressed against a threaded sleeve seat 13 connected to the upper pipe 5. The two pipes 5, 8 have pipe threads 7, 9 matching each other and the two rods 20, 22 have rod threads 21, 23 matching each other.

The lower rod 22 with the lower pipe 8 and the upper rod 20 with the upper pipe 5 in each case can be connected to each other with a lower guide element 31 and an upper guide element 32,-respectively. Said guide elements 31, 32 can prevent rotation of the respective rod relative to the respective pipe.

A sealing ring 18 can be inserted between the threaded sleeve seat 13 and the support body 16. The sealing ring 18 can be inserted into an annular groove 17 of the support body 16.

The threaded sleeve seat 13 can exhibit a bore 15. The bore 15 can exhibit a conically expanding surface in a direction toward the sprinkler device 11 and can form a valve seat. The support body 16 with its outer face 19 can rest against the bore 15.

The upper pipe 5 and the lower pipe 8 in each case can be furnished at their outer side with a hexagonal jam nut 33, 34. The outer periphery of the lower hexagonal jam nut 33 can be smaller as compared to the outer periphery of the upper hexagonal jam nut 34.

The pipe threads 7, 9 of the upper and lower pipes 5, 8 and the rod threads 21, 23 of the upper and lower rods 20, 22 can be disposed at approximately the same height level.

The rod threads and the pipe threads can have the same pitches.

A T-shaped piece "Tee" 2 with a threaded arm of a tee fitting 3 is disposed within a fire extinguishing agent line 1. An upper pipe 5 with a thread 6 is screwed into the inner thread 4 of the threaded pipe coupling furnishing a connector piece or an arm of the tee fitting 3. The upper pipe has two inner threads on respective two ends and thereby represents a coupling. The upper pipe additionally has an outer thread at the upper end, and thus also represents a reducer. The lower pipe has an outer thread on its upper end, thus representing a reducer. The upper pipe coupling or upper pipe 5 belongs to the pipe "A" of the sprinkler. The upper pipe 5 is furnished with an inner thread 7 at its lower end. A pipe reducer or lower pipe 8 with a thread 9 is screwed into the inner thread 7 of the lower end of the upper pipe 5. The lower end of the lower pipe 8 is furnished with an inner thread 10, and the sprinkler 11 is screwed into the inner thread 10 of the lower end of the lower pipe 8. The upper end of the upper pipe 5 is furnished with a further inner thread 12. A threaded sleeve seat 13 with a thread 14 is screwed into the inner thread 12 of the upper end of the upper pipe 5.. The threaded sleeve seat 13 is furnished with a bore 15, wherein the bore 15 exhibits an inner, conical face which expands in a direction toward the sprinkler 11 and which bore 15 furnishes a valve seat. A support body 16 can be pressed with its outer face 19 against the inner, conical, downwardly expanding face of bore 15. Furthermore, the support body 16 is furnished with an annular groove 17. The annular groove 17 is filled with a sealing ring 18. The lower end of the support body 16 is connected to a rod 20, wherein the rod 20 can also be furnished as a pipe. The lower end of the rod 20 is furnished with an outer thread 21. The inner thread 23 of a rod 22 can be screwed into the outer thread 21 at the lower end of the rod 20. A sprinkler support piece 24 is attached at the lower end of the rod 22 and the support piece 24 supports the upper tip of a release member 30. The sprinkler support piece 24 can form a slot relative to the sprinkler body 25 with the outer thread 26 of the sprinkler body 25. The sprinkler arms 28, connected to the sprinkler body 25, support at a lower end a counter support 27 with a sprayer dish providing a fire extinguishing rose 29. The counter support 27 supports the lower round portion of a release member. The release member 30, formed in the exemplified embodiment as a glass flask, is fixedly clamped between the support piece 24 and the counter support 27. The sprinkler support piece 24 is supported via the rods 22, 20 and the support body 16 at the threaded sleeve seat 13.

The special sprinkler according to the invention comprising the pipes 5, 8, the threaded sleeve seat 13 with the support body 16, the rods 20, 22 and the sprinkler 11 with the sprinkler support piece 24, is produced in a workshop and then delivered to the construction site. In order to set the height level "H" after screwing the upper pipe 5 into the threaded arm of the tee fitting 3, the upper pipe 5 and the upper rod 20 are furnished with an upper guide element 32 fixed against rotation. The upper guide element 32 can have a square or hexagonal shape and can restrain by said shape any rotation of the upper rod 20 relative to the upper pipe 5. In addition, a hexagonal jam nut 34 or the like is disposed at the outer side of the upper pipe 5. The hexagonal jam nut 34 allows to screw the upper pipe 5 into the unique arm of the tee fitting 3. Similarly, the lower pipe 8 and the lower rod 22 can be furnished with a lower guide element 31 preventing a relative rotation between the lower pipe 8 and the lower rod 22. The lower guide element 31 can have a square or hexagonal shape and can restrain by said shape any rotation of the lower rod 22. Furthermore, the lower pipe 8 is furnished at the outer side also with a hexagonal jam nut 33 or the like. In order to allow to screw the upper pipe 5 into the unique arm of the tee fitting 3 with a pipe wrench or the like, the lower hexagonal jam nut 33 is smaller at its periphery as compared to the upper hexagonal jam nut 34. The suspended ceiling is designated with the reference numeral 35 and is furnished with an opening 37 in the region of the sprinkler 11. The opening 37 is covered with a single-part or a two-part washer disk 36. The measure "H" is variable based on the ascending or descending slope angle of the installed fire extinguishing agent line 1. The threads 7, 9 and 21, 23 are furnished with the same thread slopes and/or pitches such that, in case of a sufficient length of the threads, the measure length "H" after installation of the special sprinkler into the ceiling and thus the length of the branched pipe "A" can be set accordingly. If the desired height level "H" has been set, then the washer disk 36, which is a two-part piece according to the exemplified embodiment, is installed and attached.

It will be understood that each of the elements described above, or two or more together, may also find a useful application in other types of sprinklers differing from the types described above.

While the invention has been illustrated and described as embodied in the context of a sprinkler for automatic fire extinguishing plants, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Sprinkler for automatic fire-extinguishing plants according to a dry system for rooms endangered by freezing with one T-shaped threaded nut (2) of a fire-extinguishing agent line (1) with a downwardly branching intermediate piece, said piece comprises upper and lower pipes (5, 8), wherein the upper pipe (5) has a lower pipe thread (7), and wherein the lower pipe (8) has an upper pipe thread (9) and a lower inner pipe thread (10), and wherein the level of the lower pipe thread (9) of the lower pipe (8) and the level of the lower inner pipe thread (10) of the lower pipe (8) do not overlap such that the lower pipe (8) is grippable from the outside at its lower end, wherein a sprinkler body is screwed into the inner pipe thread (10) at a lower end of the lower pipe (8), and a sprinkler support piece (24) resting at a release member (30) which is connected to a lower rod (22), wherein the lower rod (22) includes means for adjusting the height of the lower rod with an upper rod (20), wherein the upper rod (20) is furnished at its upper end with a support body (16) having a sealing ring (18), wherein the support body (16) is pressed against a threaded sleeve seat (13) connected to the upper pipe (5), and wherein a suspended ceiling (35) is disposed in the region of the sprinkler (11), characterized in that a lower guide element (31) is furnished to the lower pipe (8) and that an upper guide element (32) is furnished to the upper pipe (5) wherein said upper guide element (32) fixes said upper rod (20) against rotation relative to the upper pipe (5) and said lower guide element (31) fixes said lower rod (22) against rotation relative to said lower pipe (8), and wherein threads (7, 9) of the upper pipe and the lower pipe connecting the two pipes (5, 8) and rod threads (21, 23) connecting the two rods (20, 22) are formed with the same slopes, and wherein the upper pipe (5) is furnished at an outer side with an upper grippable wrenching collar (34) and the lower pipe (8) is furnished at an outer side with a lower grippable wrenching collar (33) for adjusting the overall length of the upper pipe (5) and the lower pipe (8), wherein the upper grippable wrenching collar (34) is disposed on the upper pipe (5) close to the T-shaped threaded nut, and wherein the lower grippable wrenching collar (33) is disposed on the lower pipe (8) close to the sprinkler (11).

2. Sprinkler according to claim 1 characterized in that the threaded sleeve seat (13) has a downwardly conically expanding bore (15) forming a valve-seat, and that the support body (16) with an outer face (19) rests at the bore (15) forming the valve-seat.

3. Sprinkler according to claim 1 characterized in that an outer periphery of the lower grippable wrenching collar (33) is smaller as compared to an outer periphery of the upper grippable wrenching collar (34).

4. Sprinkler according to claim 1 characterized in that the pipe threads (7, 9) of the pipes (5, 8) and the rod threads (21, 23) of the rods (20, 22) are disposed at substantially the same height level, and wherein the lower pipe thread (7) of the upper pipe (5) is applied to a lower portion of the upper pipe (5), where the lower portion of the upper pipe (5) amounts to less than one third of the length of the upper pipe (5), and wherein the upper pipe thread (9) of the lower pipe (8) is applied to the upper portion of the lower pipe (8), where the upper portion of the lower pipe (8) amounts to less than one third of the length of the lower pipe (8).

5. The sprinkler for automatic fire-extinguishing plants according to claim 1, wherein the grippable wrenching collar is a hexagonal wrenching collar.

6. Sprinkler for automatic fire-extinguishing plants according to a dry system for rooms endangered by freezing with one T-shaped threaded nut (2) of a fire-extinguishing agent line (1) with a downwardly branching intermediate piece, and with a sprinkler (11) and a sprinkler body (25) having an upper thread (26), wherein said intermediate piece comprises upper and lower pipes (5, 8), and a sprinkler support piece (24) resting at a release member (30) which is connected to a lower rod (22), wherein the lower rod (22) includes means at its upper end for adjusting the height level of the lower rod with an upper rod (20) and for solidly engaging the lower end of the upper rod (20) with the upper end of the lower rod (22), wherein the upper rod (20) is furnished at its upper end with a support body (16) having a sealing ring (18), wherein the support body (16) is pressed against a threaded sleeve seat (13) connected to the upper pipe (5), and wherein a suspended ceiling (35) is disposed in the region of the sprinkler (11), characterized in that a lower guide element (31) is furnished to the lower pipe (8) and to the lower rod (22) for preventing a relative rotation between the lower pipe (8) and the lower rod (22) and that an upper guide element (32) is furnished to the upper pipe (5) and to the upper rod (20) for restraining a rotation of the upper rod (20) relative to the upper pipe (5);

a lower thread (7) of the upper pipe and an upper thread (9) of the lower pipe connecting the upper pipe (5) to the lower pipe (8);

a lower thread (10) of the lower pipe (8) for accepting the upper thread (26) of the sprinkler body (25), wherein the level of the upper thread (9) of the lower pipe (8) and the level of the lower thread (10) of the lower pipe (8) do not overlap such that the lower pipe is grippable from the outside; and a lower rod thread (21) of the upper rod (20) and an upper rod thread (23) of the lower rod (22) are formed with the same slopes for connecting the upper rod (20) to the lower rod (22) and the upper pipe (5) is furnished at an outer side with an upper grippable wrenching collar (34), disposed on the outside of the upper pipe (5) near the upper end of the upper pipe (5), and the lower pipe (8) is furnished at an outer side with a lower grippable wrenching collar (33), disposed on the outside of the lower pipe (8) near the lower end of the lower pipe (8), and wherein the level of the wrenching collar (33) is disposed substantially below the lower end of the upper pipe (5), such that the length assumed by the upper pipe and by the lower pipe can be modified and defined after positioning between a line carrying an extinguishing agent and a hanged ceiling by tools engaging the upper pipe (5) and the lower pipe (8) relatively remote from the respective ends of the upper pipe and of the lower pipe engaging each other and for obtaining a length of the intermediate piece adapted permanently to the level of the ceiling.

7. A sprinkler branch for automatic fire extinguishing plants comprising an upper pipe having a first threaded surface on an upper end for fitting the upper pipe onto a downward threaded arm of a T-shaped fitting in a line for carrying a fire extinguishing agent, having a second threaded surface on the upper end and having a third threaded surface on a lower end;

a lower pipe having a first threaded surface on an upper end and having a second threaded surface on a lower end, wherein the first threaded surface on the upper end and the second threaded surface on the lower end do not overlap such that the lower pipe is grippable from the outside, wherein the upper pipe with the third threaded surface and the lower pipe with the first threaded surface are screwed together; a sleeve seat connected to the upper pipe;

a support body disposed in the sleeve seat, and wherein the support body can be pressed against the sleeve seat;

an upper rod having an upper end, and having a lower end, and wherein the upper rod has at its lower end a first rod thread, and wherein the upper rod is attached at the upper end of the upper rod to the support body;

a lower rod having an upper end and having a lower end, wherein the lower rod has at its upper end a second rod thread, wherein the first rod thread matches the second rod thread, and wherein the upper end of the lower rod is screwed to the lower end of the upper rod;

a sprinkler body attached to the lower end of the lower pipe;

a sprinkler support piece connected to the lower end of the lower rod, and wherein the sprinkler body and the sprinkler support piece form a sprinkler device such that the sprinkler branch is operable according to the dry system and for rooms endangered by freezing and frost, wherein the pipe pieces are branching downwardly, and wherein a suspended ceiling is disposable in a region defined by the lower pipe and the sprinkler device;

an upper guide element furnished between the upper rod and the upper pipe for preventing mutual rotation of the upper rod relative to the upper pipe;

a lower guide element furnished between the lower rod and the lower pipe for preventing mutual rotation of the lower rod relative to the lower pipe;

a first hexagonal wrenching collar attached at an outer face of the upper pipe;

a second hexagonal wrenching collar attached at an outer face of the lower pipe, wherein the outer periphery of the second hexagonal wrenching collar attached to the outer face of the lower pipe is smaller as compared to the outer periphery of the first hexagonal wrenching collar for positioning the lower pipe in a position defined by a level of the ceiling and thereby using the position of the lower pipe to provide level adaption of the sprinkler branch to the level of the ceiling.

8. A sprinkler branch for automatic fire extinguishing plants comprising an upper pipe having a first threaded surface on an upper end for fitting the upper pipe onto a downward threaded arm of a tee fitting in a line for carrying a fire extinguishing agent, having a second threaded surface on the upper end and having a third threaded surface on a lower end;

a lower pipe having a first threaded surface on an upper end and having a second threaded surface on a lower end, wherein the first threaded surface on the upper end and the second threaded surface on the lower end do not overlap such that the lower pipe is grippable from the outside, wherein the upper pipe with the third threaded surface and the lower pipe with the first threaded surface are screwed together and form a solid connection between the lower end of the upper pipe and the upper end of the lower pipe;

a sleeve seat connected to the upper end of the upper pipe; a support body disposed in the sleeve seat, and wherein the support body can be pressed against a threaded sleeve seat; an upper rod having an upper end, and having a lower end, and wherein the upper rod has at its lower end a first rod thread, and wherein the upper rod is attached at the upper end of the upper rod to the support body;

a lower rod having an upper end and having a lower end, wherein the lower rod has formed at its upper end a second rod thread, wherein the first rod thread matches the second rod thread, and wherein the upper end of the lower rod is screwed to the lower end of the upper rod;

a sprinkler body attached to the lower end of the lower pipe;

a sprinkler support piece connected to the lower end of the lower rod such that a connection between the sprinkler support piece and the lower pipe is at a substantially different level as compared to the connection between the upper end of the lower pipe and the lower end of the upper pipe, and wherein the sprinkler body and the sprinkler support piece form a sprinkler device such that the sprinkler branch is operable according to the dry system and for rooms endangered by freezing and frost, wherein the pipe pieces are branching downwardly, and wherein a suspended ceiling is disposable in a region defined by the lower pipe and the sprinkler device.

9. The sprinkler branch according to claim 8, further comprising an upper guide element furnished between the upper rod and the upper pipe for preventing mutual rotation of the upper rod relative to the upper pipe;

a lower guide element furnished between the lower rod and the lower pipe for preventing mutual rotation of the lower rod relative to the lower pipe.

10. The sprinkler branch according to claim 8, further comprising a sealing ring inserted between the threaded sleeve seat and the support body;

wherein the support body includes an annular groove, and wherein the sealing ring is inserted into the annular groove of the support body.

11. The sprinkler branch according to claim 8, wherein the threaded sleeve seat exhibits a bore, wherein the bore of the threaded sleeve seat exhibits a conically expanding surface in a direction toward the sprinkler device, wherein the threaded sleeve seat forms a valve seat, and wherein the support body with its outer face rests against the bore.

12. The sprinkler branch according to claim 8, further comprising a first wrenching collar attached at an outer face of the upper pipe;

a second wrenching collar attached at an outer face of the lower pipe, wherein the outer periphery of the second wrenching collar attached to the outer face of the lower pipe is smaller as compared to the outer periphery of the first wrenching collar for positioning the lower pipe in a position defined by the level of the ceiling and thereby using the positioning of the lower pipe to provide level adaptation of the sprinkler branch to the level of the ceiling.

13. The sprinkler branch according to claim 12, wherein the first wrenching collar is hexagonal and disposed at the upper end of the upper pipe, and wherein the second wrenching collar is hexagonal and disposed at the lower end of the lower pipe.

14. The sprinkler branch according to claim 8, wherein the third threaded surface of the upper pipe, the first threaded surface of the lower pipe, the first rod thread of the upper rod and the second rod thread of the lower rod are disposed at substantially the same height level.

15. The sprinkler branch according to claim 8, wherein the first rod thread, the second rod thread, the third threaded surface of the upper pipe and the first threaded surface of the lower pipe have the same pitches, and wherein the corresponding rod threads and the corresponding pipe threads have the same pitches.

16. The sprinkler branch according to claim 8, further comprising a ring washer, wherein the sprinkler body is furnished with an upper step, said step defining a minimum and a maximum for an inner circle of the ring washer, and wherein the outer diameter of the washer is provided sufficient for resting at an edge of a hole in a ceiling panel.

17. The sprinkler branch according to claim 8, wherein the sprinkler body is furnished with a threaded surface on an upper end for attachment to the second threaded surface of the lower pipe.

18. The sprinkler branch according to claim 8, further comprising a release member having a first end and having a second end, wherein the sprinkler support piece arresting a first end of the release member;

a counter support for supporting the second end of the release member and for providing simultaneously a sprinkler rose for imparting a horizontal speed component to a fluid arriving through the lower pipe;

sprinkler arms attaching the sprinkler rose to the sprinkler body, and wherein the threaded surface of the sprinkler body is an outer thread, and wherein the second threaded surface of the lower pipe is an inner thread.

* * * * *